US008220100B2

(12) United States Patent
Diamond

(10) Patent No.: US 8,220,100 B2
(45) Date of Patent: Jul. 17, 2012

(54) HAIR BRUSH WITH CURVED STYLING SURFACE

(75) Inventor: Ronald Teddy Diamond, New York, NY (US)

(73) Assignee: Conair Corporation, Stamford, CT (US)

( * ) Notice: Subject to any disclaimer, the term of this patent is extended or adjusted under 35 U.S.C. 154(b) by 484 days.

(21) Appl. No.: 12/195,828

(22) Filed: Aug. 21, 2008

(65) Prior Publication Data

US 2009/0019653 A1 Jan. 22, 2009

Related U.S. Application Data

(63) Continuation-in-part of application No. 11/446,762, filed on Jun. 5, 2006, now abandoned.

(60) Provisional application No. 60/687,479, filed on Jun. 3, 2005.

(51) Int. Cl.

| | |
|---|---|
| ***A47L 13/00*** | (2006.01) |
| ***A47L 23/04*** | (2006.01) |
| ***E04F 21/16*** | (2006.01) |
| ***A45D 24/06*** | (2006.01) |
| ***A45D 24/04*** | (2006.01) |

(52) U.S. Cl. ..... 15/106; 132/132; 132/138

(58) Field of Classification Search ..... 132/132, 132/138; D4/120, 106; 15/106

See application file for complete search history.

(56) References Cited

U.S. PATENT DOCUMENTS

| | | | | | |
|---|---|---|---|---|---|
| 941,586 | A | * | 11/1909 | Purdy | 132/144 |
| 1,365,079 | A | * | 1/1921 | Bardsley | 132/132 |
| 1,588,241 | A | * | 6/1926 | Leland | 132/224 |
| 2,004,044 | A | * | 6/1935 | Fiegel | 132/120 |
| 3,935,423 | A | * | 1/1976 | Pucci | 219/225 |
| 4,567,904 | A | * | 2/1986 | Pitcher et al. | 132/266 |
| 5,865,188 | A | * | 2/1999 | Marquez | 132/132 |
| 6,047,707 | A | * | 4/2000 | Johnson | 132/232 |
| 6,070,596 | A | * | 6/2000 | Altamore | 132/224 |
| 6,119,702 | A | * | 9/2000 | Habibi | 132/224 |
| D501,275 | S | * | 1/2005 | Habibi | D28/35 |
| 7,481,228 | B2 | | 1/2009 | Ragosta et al. | |
| 2005/0016557 | A1 | * | 1/2005 | Fasan | 132/132 |
| 2007/0199574 | A1 | * | 8/2007 | Ragosta et al. | 132/238 |

FOREIGN PATENT DOCUMENTS

KR 2005011799 A * 1/2005

* cited by examiner

*Primary Examiner* — Bryan R Muller

(74) *Attorney, Agent, or Firm* — McCormick, Paulding & Huber LLP

(57) ABSTRACT

A hairbrush 10 has rounded outer surfaces 23, 25 of hinged heads 22, 24 that, when the brush is closed, achieve a closed form that is generally round or spherical in cross-sectional shape. Another aspect of the present invention includes inner head surfaces 26, 28 that support bristles and that are complementarily shaped concave and convex, respectively, to hold a tuft of hair in a curved position as the tuft is pulled through the closed heads.

4 Claims, 4 Drawing Sheets

HAIR BRUSH WITH CURVED STYLING SURFACE

CROSS-REFERENCE TO RELATED APPLICATIONS

This application claims priority from U.S. Provisional Patent Application No. 60/687,479, filed Jun. 3, 2005 and U.S. Non-provisional patent application Ser. No. 11/446,762, filed Jun. 5, 2006, both prior applications hereby being incorporated herein in their entirety.

BACKGROUND OF THE INVENTION

1. Field of the Invention

The present invention relates to hairbrushes and, more particularly, to hairbrushes having two heads that are hingedly connected.

2. Description of Related Art

Known hairbrushes, especially those used for straightening or for styling, have two brush heads with bristles that are joined by a hinge and adapted to close around a tuft of hair so that the hair is sandwiched between the brush heads while the brush is pulled through the hair. This can be used to straighten hair, typically done in cooperation with a hairdryer, or it can be used to introduce a "flip" or curved hair end by rotating the brush while pulling through and away. This type of hinged brush is often called a "straightening brush." Known straightening brushes have flat or planar surfaces on the heads on sides that are opposite to and adjacent to the bristles. These flat or planar surfaces are not as well adapted for flip or curl techniques as, for example, the rounded surfaces found on the outside barrel of a curling iron. A curling iron can be moved relative to the hair, i.e. in a flip or curl manner, to introduce a desired style.

OBJECTS AND BRIEF SUMMARY OF THE INVENTION

It is desirable to provide a hairbrush that is optimally adapted to styling techniques, such as flip or curl, or others where rotation of the brush relative to the hair while pulling is desired, while avoiding the shortcomings described above and while achieving other benefits.

A hairbrush according to the present invention has hinged heads having rounded outer surfaces that, when the brush is closed, achieve a closed form that is generally round or spherical in cross-sectional shape. Another aspect of the present invention includes inner head surfaces that support bristles and that are complementarily shaped concave and convex, respectively, to hold a tuft of hair in a curved position as the tuft is pulled through the closed heads.

DETAILED DESCRIPTION OF THE PREFERRED EMBODIMENT

Figure 1A:
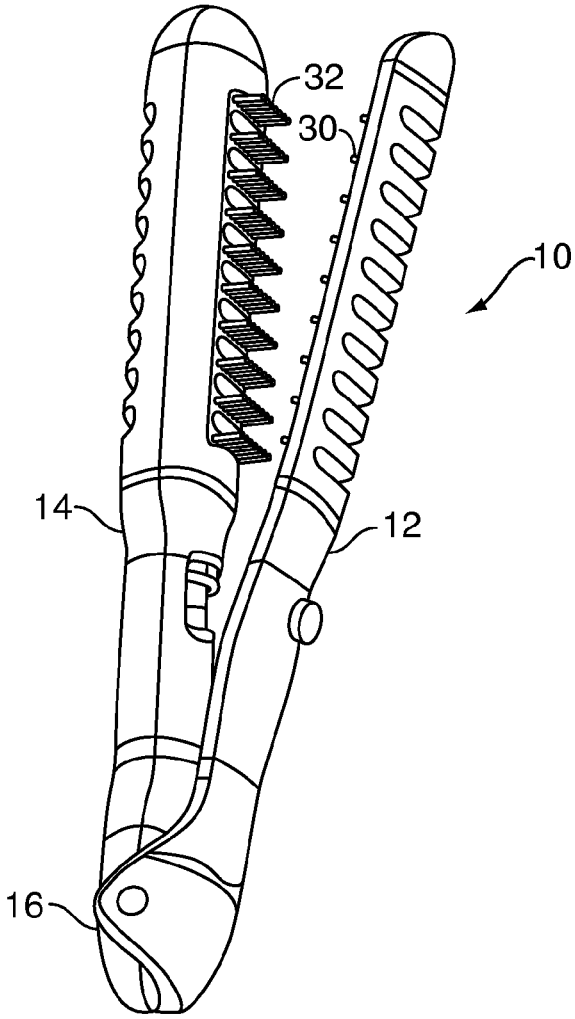
FIG. 1A is a perspective view of a hairbrush according to the present invention.
Figure 1B:
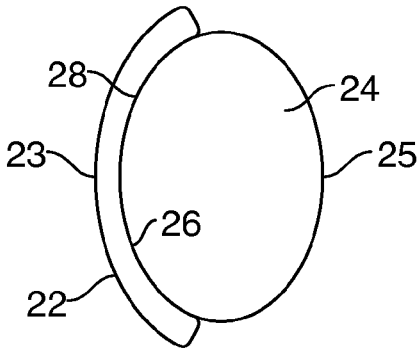
FIG. 1B is a cross-sectional view of a hairbrush according to the present invention.
Figure 1C:
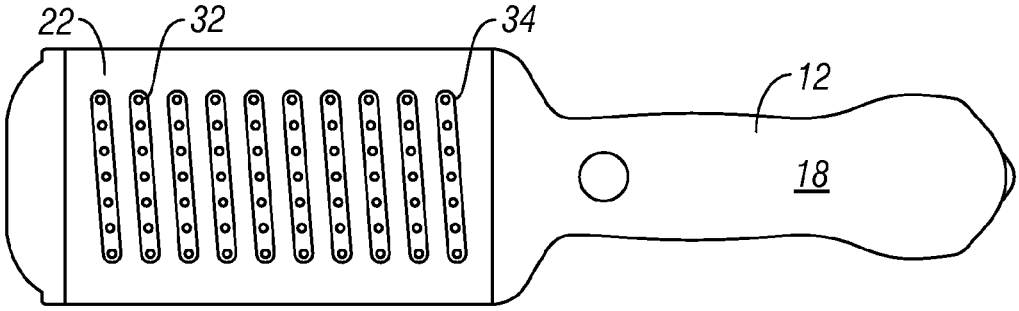
FIG. 1C is a top view of a hairbrush according to the present invention.

Referring to FIGS. 1A-E, a brush 10 according to the present invention has a first section 12 and a second section 14, each joined by a spring-loaded hinge 16. The first and second sections 12, 14 have respective handle portions 18, 20, and respective brush head sections 22, 24 having convex outer surfaces 23, 25. As can be seen in FIG. 1B, the first brush head 22, and, indeed, the entire first section 12 including the handle portion 18 has an inner concave surface 26 and the second section 14, from head 24 to handle 20, also has an inner convex surface 28, which close together in a complementary, nesting manner. As such, the entire length of each of the first and second sections 12, 14, from head 22, 24 to handle 18, 20, engage in a nesting manner via the convex 28 and concave surfaces 26.

Brush bristles 30, 32 are disposed in an array on each respective surface 26, 28. Each brush head 22, 24 also is pierced by an array of slots 34, 36 corresponding to the array of bristles 30, 32 on the opposing brush head. Accordingly, the two brush heads 22, 24 are designed and adapted so that they may be brought together such that substantially the entirety of the inner concave surface 26 closely abuts substantially the entirety of the inner convex surface 28 so as to clamp a tuft of hair, with the bristles 30, 32 mating into the slots 34, 36 so as to separate the clamped tuft of hair into smaller strands.

When a tuft of hair is clamped between the complementary surfaces 26, 28, it is held in a curved path and a user can then rotate the brush while pulling the brush along the tuft of hair so that the hair is guided along the arcuate path defined by the complementary surfaces 26, 28. The convex outer surfaces 23, 25 cooperate with the concave and convex inner surfaces 26, 28 to impart a flip or curl to the hair when the brush is closed over a tuft of hair and the brush is rotated as it is pulled through the hair. Rotation of the brush is about an imaginary axis longitudinally aligned through the handle and head portions when the brush is closed.

Figure 1D:
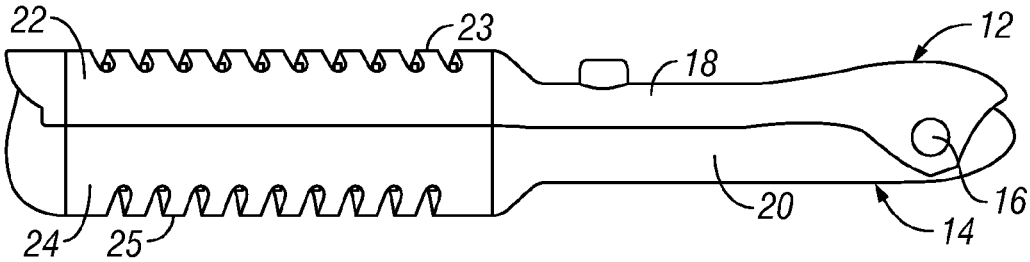
FIG. 1D is a side view of a hairbrush according to the present invention.
Figure 1E:
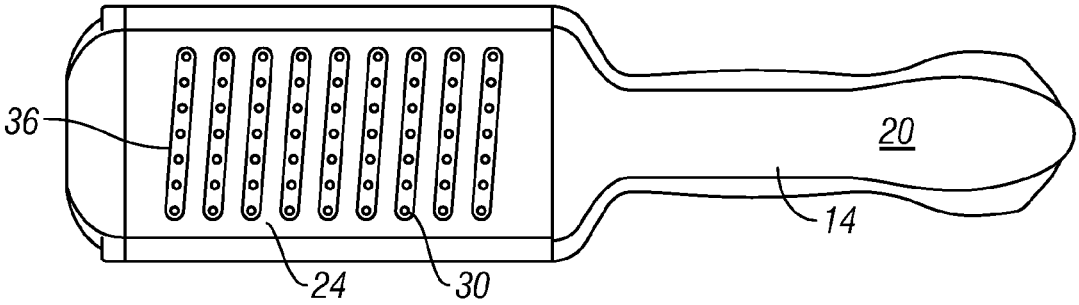
FIG. 1E is a bottom view of a hairbrush according to the present invention.
Figure 2A:
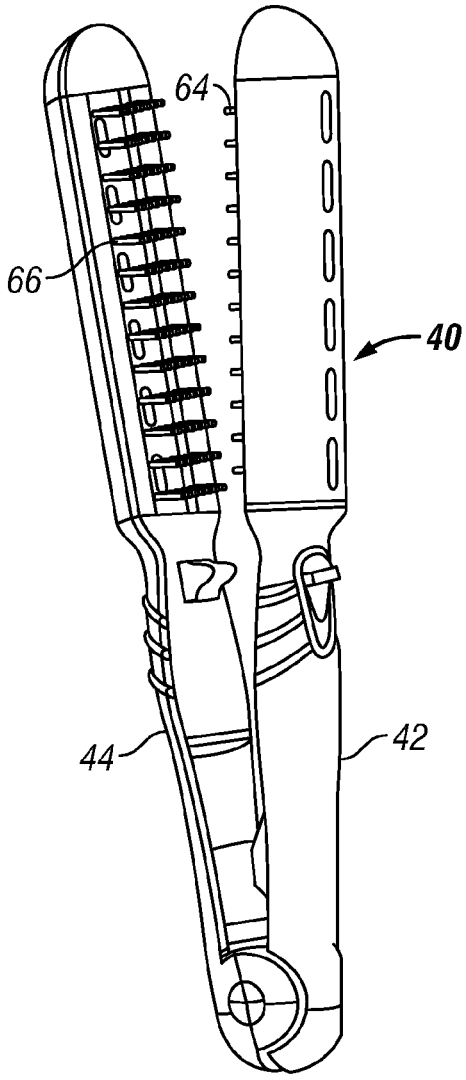
FIG. 2A is a perspective view of a hairbrush according to a second embodiment of the present invention.
Figure 2B:
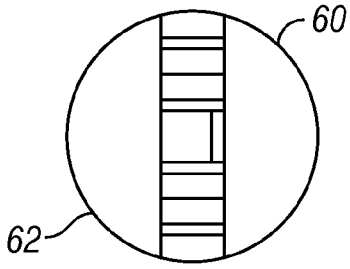
FIG. 2B is a cross-sectional view of a hairbrush according to a second embodiment of the present invention.
Figure 2C:
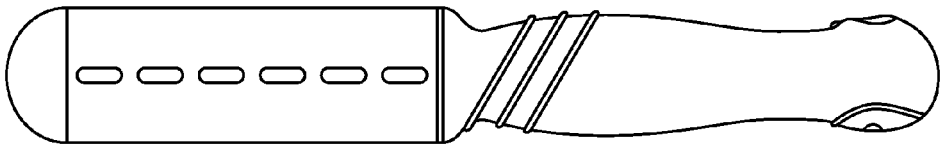
FIG. 2C is a top view of a hairbrush according to a second embodiment of the present invention.
Figure 2D:
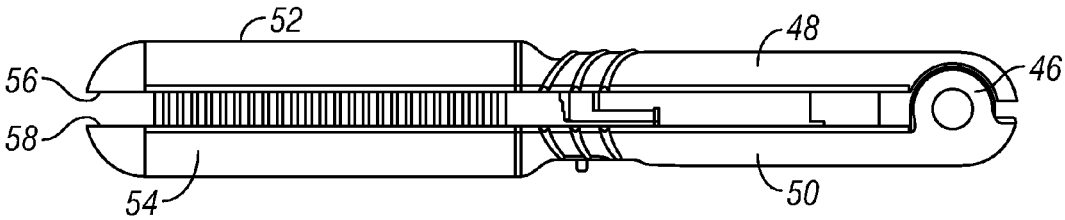
FIG. 2D is a side view of a hairbrush according to a second embodiment of the present invention.
Figure 2E:
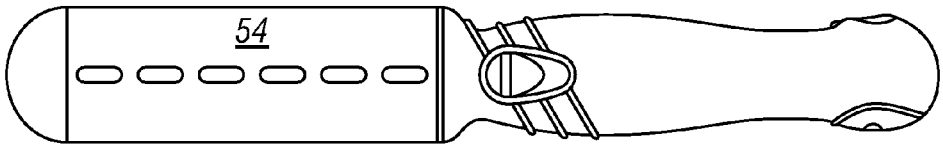
FIG. 2E is a bottom view of a hairbrush according to a second embodiment of the present invention.

In addition, as shown in FIG. 1D, the placement and location of the hinge 16 between the inner surface 26 and the outer surface 25 of the second section 14 facilitates the entire length of the first section 12 to engage in a nesting manner with the second section 14.

Another embodiment is shown in FIGS. 2A-2E, wherein a brush 40 according to the present invention has a first section 42 and a second section 44, joined together by a spring-loaded hinge 46. The first and second sections 42, 44 have respective handle portions 48, 50, and respective brush head sections 52, 54. Each head 52, 54 has a generally flat inner surface 56, 58 and a convex outer surface 60, 62. Bristles 64, 66 are located on the inner surfaces 56, 58.

When a tuft of hair is clamped between the heads 52, 54, and the brush is rotated while being pulled through the hair, the hair rolls around the convex outer surfaces 60, 62 to impart a flip, curl, or other desired style.

The present invention brush embodiments shown herein may include various additional features such as: ceramic or tourmaline coatings to emit ions; an ionic emitter that is powered by an electrical charge; an electric heating element; an electric fan for blowing heated air onto hair being styled; a variety of electric control buttons and display readouts including LCD, LED or other lights, and other features.

As one advantage of the present invention, the curved surfaces 23, 25, 26, 28 or 60, 62 respectively enhance the user's ability to efficiently impart a curl or a flip to hair clamped within the brush 10 or 40.

The inventive brush 10 or 40 may be equipped with a locking mechanism such as a spring button with a spring jaw or a catch with the latch, such locking mechanisms advantageously permits use of the brush 10 or 40 by a user having reduced grip strength.

While the preferred embodiment of the present invention has been herein described, various modifications may be made without departing from the scope of the present invention.

What is claimed is:

1. A hair brush comprising:

a first portion comprising a first handle and a first head, said first portion having a first inner concave surface and a first outer convex surface opposed to said first inner concave surface, said first inner concave surface extending substantially an entire length of said first portion, said first head having a plurality of first bristles extending from said first inner concave surface thereof and a plurality of first slots extending entirely through said first head from said first inner concave surface to said first outer convex surface and aligned with a plurality of second bristles;

a second portion comprising a second handle and a second head, said second portion having an second inner convex surface and a second outer convex surface opposed to said second inner convex surface, said second inner convex surface extending substantially an entire length of said second portion, said second head having said plurality of second bristles extending from said second inner convex surface thereof and a plurality of second slots extending entirely through said second head from said second inner convex surface to said second outer convex surface and aligned with said plurality of first bristles; and a hinge joining said first portion and said second portion so that said first inner concave surface and said second inner convex surface face each other, wherein substantially an entirety of said first inner concave surface and said second inner convex surface are adapted to contact each other when said first portion and said second portion are pivoted about said hinge toward each other.

2. The hair brush of claim 1, further comprising:

a selectively actuatable locking mechanism for locking said first portion and said second portion in a position wherein substantially said entirety of said first inner surface and said second inner surface contact each other.

3. The hair brush of claim 1, wherein:

at least a portion of said brush has a ceramic coating.

4. The hair brush of claim 1, wherein:

at least a portion of said brush has a tourmaline coating.

* * * * *